United States Patent [19]

Yakulis, Jr. et al.

[11] Patent Number: 4,759,523

[45] Date of Patent: Jul. 26, 1988

[54] FLASK SUPPORT SYSTEM

[75] Inventors: George Yakulis, Jr., Pittsburgh; David M. Cannon, Allison Park; Robert M. Newland, Glenshaw, all of Pa.

[73] Assignee: Instruments for Research and Industry, Cheltenham, Pa.

[21] Appl. No.: 73,059

[22] Filed: Jul. 13, 1987

[51] Int. Cl.[4] ..... A47K 1/08

[52] U.S. Cl. ..... 248/311.2; 211/71; 248/142; 248/315

[58] Field of Search ..... 248/311.2, 137, 140, 248/141, 142, 311.3, 315, 318, 94, 309.1; 211/71; 5/122, 123, 94, 98 R

[56] References Cited

U.S. PATENT DOCUMENTS

| | | | |
|---|---|---|---|
| 1,609,246 | 11/1926 | Hamburger | 248/137 X |
| 1,882,645 | 10/1932 | Kail | 248/94 X |
| 2,546,770 | 3/1951 | Morey | 211/71 |
| 2,880,953 | 4/1959 | Dicks | 248/311.2 X |
| 3,051,428 | 8/1962 | Schult | 248/311.2 X |
| 4,043,538 | 8/1977 | Schreyer | 248/318 X |
| 4,191,350 | 3/1980 | Ormond | 248/311.2 X |

FOREIGN PATENT DOCUMENTS

| | | | |
|---|---|---|---|
| 273726 | 10/1966 | Australia | 248/311.2 |

*Primary Examiner*—David L. Talbott
*Attorney, Agent, or Firm*—Paul Lipsitz

[57] ABSTRACT

A supporting structure for a large laboratory flask comprising a supporting frame, a ring or hoop swivelly attached to said frame, flask supporting straps suspended from said ring, and locking and unlocking means cooperating between said frame and said ring in a fixed or swivelling condition.

7 Claims, 2 Drawing Sheets

FLASK SUPPORT SYSTEM

BACKGROUND OF THE INVENTION

This invention relates to a support for large laboratory flasks which are employed for chemical reactions and other chemical processing where large volumes of material are used. Generally, such flasks are round-bottom flasks of about 12 to about 22 liter size and when filled or partially filled with material are heavy and hard to handle. Further, the material in such flasks is usually heated with a heating mantle to effect a chemical reaction or distillation and the contents need to be poured from the flask while hot, making handling even more difficult and hazardous. Another problem with conventional support systems which use a heating mantle for support of large flasks is that when the heating mantle is removed the total weight of the flask and its contents is so great that the supporting arms from the neck of the flask to the supporting frame often will bend which contributes further to difficult handling.

It is an object of this invention to provide a support system for large flasks, particularly round-bottom flasks, which makes possible the easy handling of such flasks while hot and further provides means for easily tipping and pouring the contents out of the flask. It is a further object of the invention to provide a positive and safe means of support for a large, round-bottom flask without a heating mantle.

BRIEF STATEMENT OF THE INVENTION

The invention provides for a flask supporting structure comprising a supporting frame, a ring or hoop swivelly attached to said frame, flask supporting straps suspended from said ring and locking and unlocking means cooperating between said frame and said ring which enable said ring to be put in a fixed or swivelling position, whereby, when a flask is supported within said ring by said supporting straps, the ring and flask may be placed in a fixed position adapted for heating or other operation and when the ring and flask is put in a swivelling condition, the flask may easily be tilted to remove its contents.

DISCUSSION OF PRIOR ART

U.S. Pat. No. 2,546,770 describes a quick release system to rapidly remove heating devices from the article being heated. More specifically, the device of this patent relates to a manually releasable device for quickly dropping a heater from contact with a flask or other reaction vessel by swinging the heating device downwardly and to one side and then holding it firmly in that position. However, the flask is held fixed in the device in the usual manner by means of clamps and cannot be tilted to empty its contents nor are the handling and safety hazards discussed above reduced in any way.

DETAILED DESCRIPTION OF THE INVENTION

Figure 1:
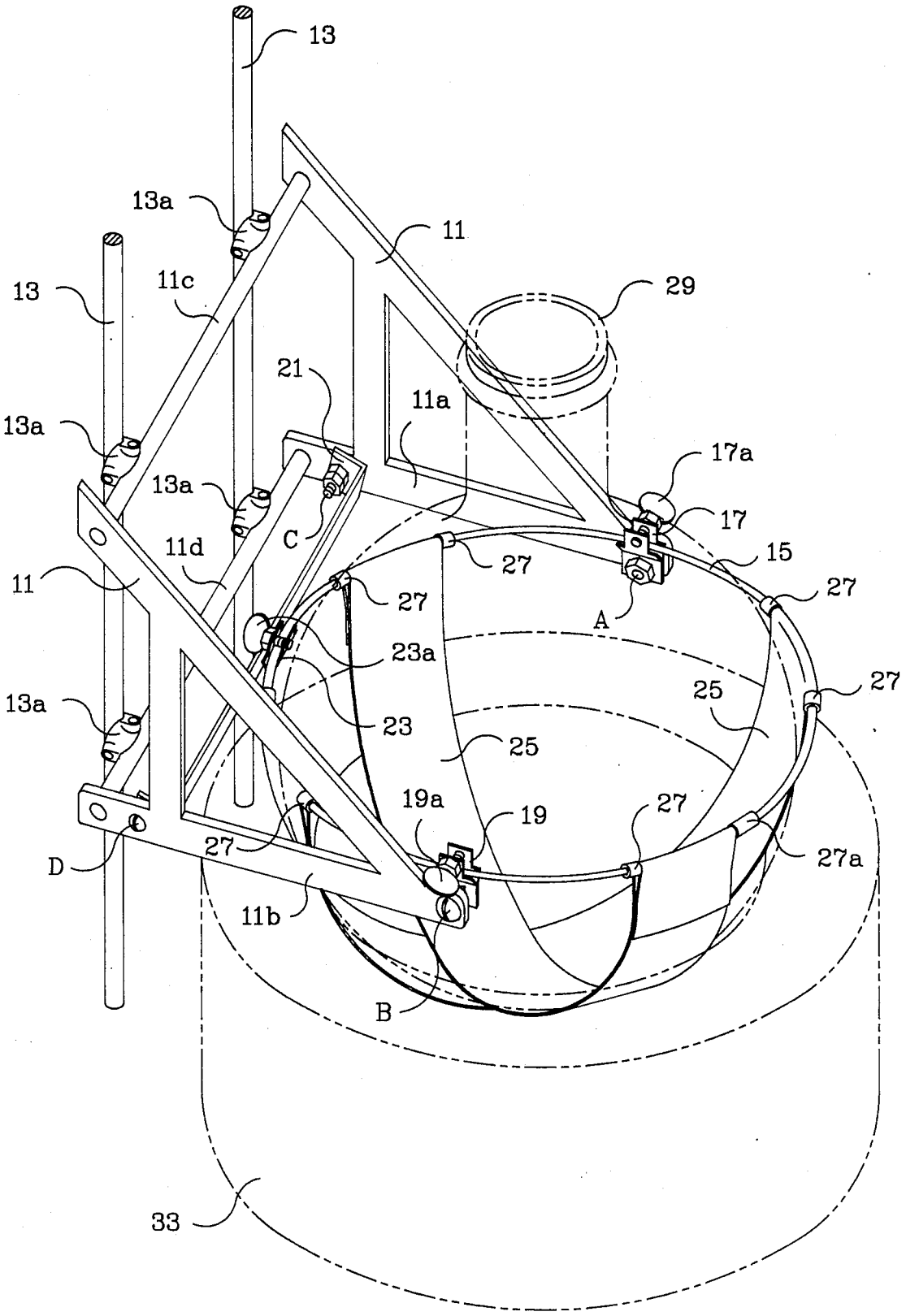
FIG. 1 is an overall view of the device of the invention.

Referring to FIG. 1, a supporting frame (shown generally as 11) is affixed by clamps (13*a*) and rods (11*c* and 11*d*) to the frame to a conventional rod support system (13) normally used in the laboratory environment. A ring or hoop (15) is mounted at swivel points (bolts A and B) on arms (11*a* and 11*b*) which arms extend horizontally from the rear of the frame (11). The bolts A and B also mount U-shaped retaining clamps (17 and 19) and thumbscrews (17*a* and 19*a*) as a means of locking and unlocking the ring (15) within the two vertical sides of the U of the clamps to thereby put the ring in a fixed or swivel condition. Also, swivelly mounted in a horizontal position (preferably by means of a nut and bolt) between arms 11*a* and 11*b* and in tangent with the rear of the ring (15) is a stabilizing bar (21) which swivels on bolts (C and D). A retaining clamp (23) which is like that of clamps 17 and 19 is bolted or otherwise affixed to the ring (15) in juxtaposition to the center of the bar (21) and means are provided to fasten said ring (15) to said bar (21) with said clamp (23), usually by means of a thumbscrew (23*a*) which threads through a hole in the center of the bar (21) to said clamp (23).

Suspended from the ring (15) is a flask support which preferably is comprised of flexible, fiberglass webbed straps (25) which may be sewed together at the bottom where they cross. The straps are looped at their ends so as to fit on the ring (15) and stops (27) are provided on the ring to hold the straps at a fixed, essentially equidistant position around the ring. These stops are usually of metal and are generally held in place by a set screw, but other stop means may be used. Stop 27*a* is somewhat longer than the other stops and serves to cover the butted ends of the ring (15). By removing stop 27*a*, worn straps (25) may be removed and new straps put on, replacing stop 27*a* to hold the butted ends of the ring together.

Shown in FIG. 1 in phantom lines is a flask (29) resting on straps (25) and beneath the flask (29), also shown in phantom lines, is an electric heating mantle (33) which surrounds the flask, but does not provide support for it. The heating mantle is supported on a jack (not shown).

The fiberglass straps are fully compatible with the flask and with the heating mantle. The straps are non-abrasive and do not scratch the flask and since they are thin and made of the same material as the surface of the heating mantle, they permit the flask to fit snugly within the mantle with no insulation effect.

Figure 2:
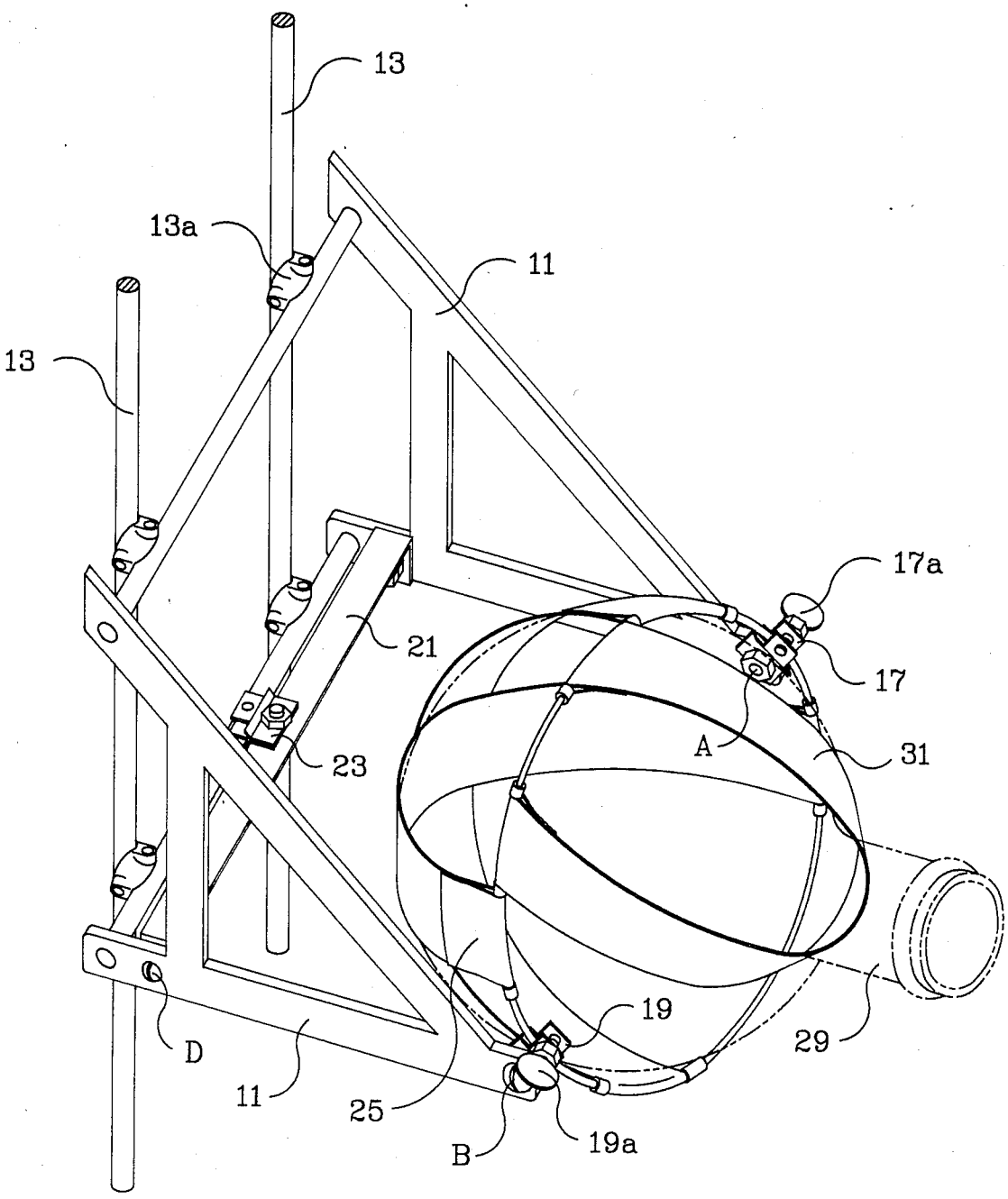
FIG. 2 is a view of the device with the flask in a pouring position.

Referring now to FIG. 2, the flask support of the invention is shown in a pouring position allowing the contents of the flask to be poured into a receiver (not shown). As shown in FIG. 2, the bar (21) is swung away from the flask (29) toward the rear of the frame (11) in order to allow the flask to be swung down to its pouring position. Of course, the flask may be swung down further than shown in order to completely empty its contents.

Also shown in FIG. 2 and fastened to the ring (15) is an optional retaining loop (31) which is also preferably made of flexible fiberglass, but may be of other material. This retaining loop serves to prevent the flask from tipping too far when it is placed in a pouring position. Of course, other means for restraining the flask may be employed and will be adapted to the type of flask in the support device. The skilled art worker will readily devise appropriate restraining loops for multi-necked flasks which may also be used in the device of the invention.

Operation of the device is quite simple and straightforward. The ring (15) is brought to a horizontal position as shown in FIG. 1 and clamps (17, 19, and 23) are tightened by the thumbscrews (17*a*, 19*a*, and 23*a*) to maintain that fixed position. The flask with its contents is placed within the ring on the supporting straps (25) and the heating mantle (33) is raised by a jack or other means (not shown) so that the heating mantle surrounds the flask bottom. When the processing is completed, the heating mantle is lowered and removed and the clamps (17, 19, and 23) loosened in order to put the flask support in a swivable condition. The flask is then easily swung down so that its contents flow from the neck into an appropriate container. A particular advantage of the support of the invention is that when a reaction in the flask becomes exothermic or gets out of control, it is easy to lower the jack and thereby remove the heating mantle from the flask while the flask remains supported by the device of the invention.

It will be understood that the device of the invention may also be used effectively with cooling baths and the like. Further, the flask supporting straps may be modified by having a centrally located hole where the webbed straps cross so as to accomodate a flask with a bottom outlet. Other variations and modifications of the apparatus will be apparent to the skilled art worker.

We claim:

1. In combination, a large laboratory flask and a support for said flask comprising a supporting frame, a ring swivelly attached to said frame, stabilizing means swivelly attached to a rear section of said supporting frame locking and unlocking means cooperating between said frame and said ring and between said stabilizing means and said ring to place said ring in a fixed or swivelling condition, flask supporting means suspended from said ring, and a flask supported by said supporting means suspended from said ring.

2. The combination of claim 1 wherein the flask is supported by flexible fiberglass straps.

3. The combination of claim 2 wherein stops keep said straps essentially equidistant from each other.

4. In combination, a large laboratory flask, a heating mantle therefor and a supporting structure for said flask comprising a supporting frame adapted to be affixed to a laboratory rod support system, a ring swivelly attached to said frame, stabilizing means swivelly attached to a rear section of said supporting frame, fiberglass straps looped over said ring to support a flask within said ring, locking and unlocking means cooperating between said frame and said ring and between said stabilizing means and said ring to place said ring in a fixed or swivelling position, whereby said flask in said ring may be held in an upright position and be heated by said heating mantle or after removing said mantle, said ring and said flask may be swivelled to a position enabling the contents of said flask to be completely removed.

5. The supporting system of claim 4 wherein stops are positioned around said ring to hold straps essentially equidistant from each other.

6. The system of claim 5 wherein said ring is a split ring butted together enabling said straps to be replaced.

7. A method for heating a large laboratory flask and its contents with a heating mantle and for safely and easily removing the hot contents of said flask which comprises resting said flask in a locked upright position in a support comprising a supporting frame, a ring swivelly attached to said frame, stabilizing means swivelly attached to a rear section of said supporting frame, locking and unlocking means cooperating between said frame and said ring and between said stabilizing means and said ring to place said ring in a locked upright or swivelling condition and flask supporting means suspended from said ring, contacting said resting flask with a heating mantle to heat the contents of said flask, removing said mantle after said contents have been heated and placing said ring in a swivelling position and swivelling said ring and said flask to remove the contents from said flask.

* * * * *